US007517109B2

(12) United States Patent
Kim et al.

(10) Patent No.: US 7,517,109 B2
(45) Date of Patent: Apr. 14, 2009

(54) FLASHLIGHT WITH ROTARY HEAD BRIGHTNESS CONTROL AND DETACHABLE TAILCAP MOUNT

(75) Inventors: Paul Y. Kim, Santa Ana, CA (US); John W. Matthews, Newport Beach, CA (US); Robert L. Kolb, Garden Grove, CA (US)

(73) Assignee: SureFire, LLC, Fountain Valley, CA (US)

( * ) Notice: Subject to any disclaimer, the term of this patent is extended or adjusted under 35 U.S.C. 154(b) by 159 days.

(21) Appl. No.: 11/700,755

(22) Filed: Jan. 30, 2007

(65) Prior Publication Data

US 2008/0180946 A1 Jul. 31, 2008

(51) Int. Cl.
*F21L 4/04* (2006.01)

(52) U.S. Cl. ..... 362/205; 362/191; 362/295; 362/398

(58) Field of Classification Search ..... 362/190, 362/191, 202, 205, 208, 295, 394, 398, 432
See application file for complete search history.

(56) References Cited

U.S. PATENT DOCUMENTS 2,784,304 A * 3/1957 Dircksen et al. ..... 362/295
3,539,796 A * 11/1970 Zychal ..... 362/295
5,379,195 A * 1/1995 Epstein ..... 362/191
5,629,105 A 5/1997 Matthews
6,062,703 A * 5/2000 Tsao ..... 362/191
6,386,730 B1 5/2002 Matthews
6,669,353 B2 * 12/2003 Kung ..... 362/208
6,955,445 B2 * 10/2005 Omowale ..... 362/205
2006/0171142 A1 * 8/2006 Abel et al. ..... 362/190
2007/0103917 A1 * 5/2007 Wu et al. ..... 362/398

* cited by examiner

*Primary Examiner*—Y My Quach Lee
(74) *Attorney, Agent, or Firm*—Haynes and Boone, LLP

(57) ABSTRACT

A flashlight has a lamp assembly with a number of operating states including an off state and a number of different brightness level output states The flashlight has an elongated housing with opposed forward and rear ends. The housing has a body portion extending to the rear end, and a head portion rotatably attached to the body portion and extending to the forward end. The lamp operating state is based on the rotational position of the head portion with respect to the body. The body portion and head portion may be cylindrical elements of a common diameter. The head portion may include an electronic component having a rotatable input that is engaged by an element on the body portion. The flashlight may include a removable end portion opposite the head portion, with a support facility operable to support the housing, such that a user does not need to contact the housing.

31 Claims, 4 Drawing Sheets

FIG. 5
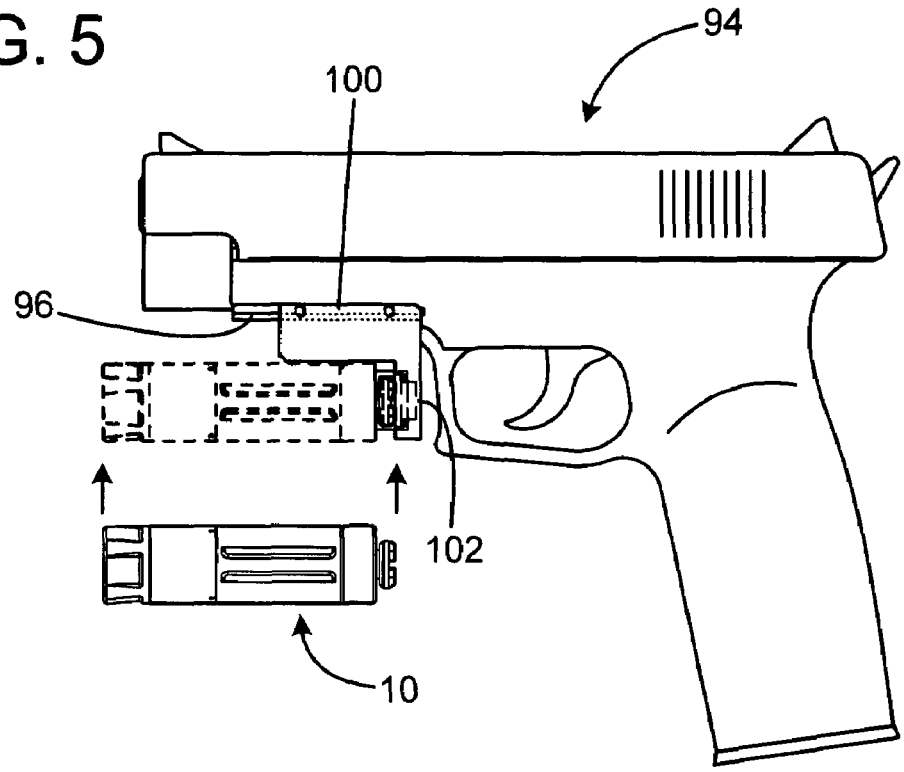
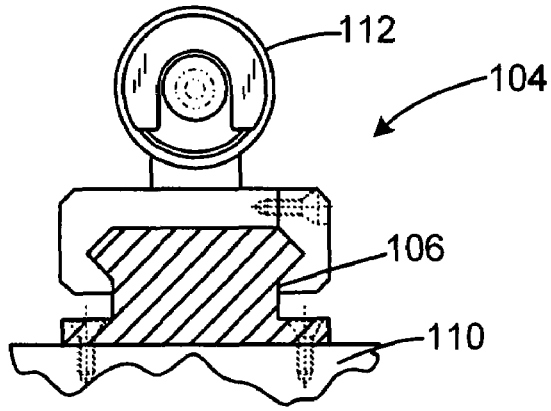
FIG. 6

FLASHLIGHT WITH ROTARY HEAD BRIGHTNESS CONTROL AND DETACHABLE TAILCAP MOUNT

FIELD OF THE INVENTION

This invention relates to flashlights, and more particularly to means for controlling flashlight output.

BACKGROUND OF THE INVENTION

Flashlights are conveniently-sized battery powered portable light sources, which provide the user with a source of illumination. The illumination could be white light or light of a specific color, or even light outside the visible range of wavelengths, such as ultra violet or infrared radiation. The "color" or wave length of the light will depend on the nature of the light source or light sources used in the flashlight. These would typically be either tungsten lamps, ARC lamps, light emitting diodes (LEDs), lasers, or any other emitter.

Because of the general nature of flashlights and their wide range of applications, it is very desirable for a flashlight to be able to emit, at the user's direction, different levels of light output, and/or different colors or wavelengths of light. This can be accomplished using multiple light sources or a single light source, which can be adjusted to provide different levels of light output.

The principal light source used in flashlights is the tungsten filament lamp, as alternatives suffer inadequate illumination, or excessive battery consumption. Tungsten filament lamps, however, cannot be effectively used as a variable output light source because they must be operated close to their design point (current & voltage) if they are to retain their efficiency in converting electrical energy to light. Generally speaking, the same thing can also be said about ARC lamps. Thus, if one wanted two significantly different light outputs from the same flashlight, this would require the use of two different lamps. Examples of such prior art systems are described in Matthews U.S. Pat. No. 5,629,105 and Matthews U.S. Pat. No. 6,386,730, the former teaching the use of a second lamp protruding through the reflector at a point offset to the side of the main lamp which is located at the focal point of the (parabolic) reflector, and the latter teaching the use of two lamps each with its own reflector, the reflectors merged together in a manner such that the light from each lamp interacts only with its own reflector. Both patents are incorporated by reference herein.

In such existing systems, the switching system consists of mechanical contact arrangement where the physical axial displacement of a switch system element (either by direct finger or thumb pressure or by rotation of a tail cap or head of the flashlight) causes first one lamp to be connected to the battery, and additional applied pressure or flashlight element rotation causes the second lamp to be connected to the battery. In some cases, the design is such that the first lamp is disconnected when the second lamp is connected to the battery. In other cases, the first lamp remains connected when the second lamp is connected.

Other flashlights employ a dimmable light source or light sources. Such flashlights may have a variety of control switches to select the dim level. This may include a rotating collar that sets dim level based on position, a sliding switch that moves linearly to set dim level, and other options that employ a duration of sustained switch contact to ramp up or down light levels. While suitable for some applications, existing dimming controls are not well-suited for very compact flashlights.

Very compact flashlights are small when compared to adult hands, and lack adequate surface area to provide for switches needed for dimming. Simply scaling down existing flashlight designs results in switches that are overly small, do not leave adequate room for gripping the light, or are otherwise inconvenient for users with large hands. Such switches further add bulk and complexity to flashlights, limiting the desired miniaturization of such flashlights. A particular concern is that with many flashlights having dimensions limited by the cylindrical batteries they contain, existing dimming switches must be positioned outside of the battery envelope, and thereby expand the circumference or other dimensions of the flashlight beyond that of the desired slim cylinder.

Flashlights gain additional usefulness for many applications with an ability to be mounted to or connected to other elements. For instance, a flashlight may be mounted to a vehicle bracket, a lanyard, a firearm, or a bicycle. Such mountings enable the flashlight to be used without occupying the user's hands. However, such mountings may be bulky or cumbersome, and may be slow or difficult to release the flashlight if normal handheld use is desired.

It should be noted that the term "lamp" is used in its most general meaning, namely that of any light source (which could be a tungsten filament lamp, an LED, a laser or an ARC Lamp) of any wavelength.

SUMMARY OF THE INVENTION

The present invention overcomes the limitations of the prior art by providing a flashlight having a lamp assembly with a number of operating states including an off state and a number of different brightness level output states The flashlight has an elongated housing with opposed forward and rear ends. The housing has a body portion extending to the rear end, and a head portion rotatably attached to the body portion and extending to the forward end. The lamp operating state is based on the rotational position of the head portion with respect to the body. The body portion and head portion may be cylindrical elements of a common diameter. The head portion may include an electronic component having a rotatable input that is engaged by an element on the body portion. The flashlight may include a removable end portion opposite the head portion, with a support facility operable to support the housing, such that a user does not need to contact the housing.

BRIEF DESCRIPTION OF THE DRAWINGS

FIG. 5 is a side view of a flashlight according to the preferred embodiment of the invention, mounted to a firearm.

FIG. 6 is a sectional end view of a flashlight mounting element attached to a firearm rail.

DETAILED DESCRIPTION OF A PREFERRED EMBODIMENT

Figure 1B:
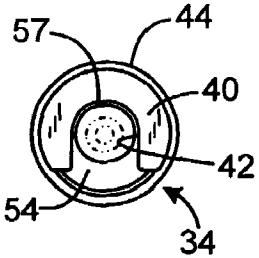
FIG. 1*b* is an end view of an attachment facility for the preferred embodiment of the invention.
Figure 1A:
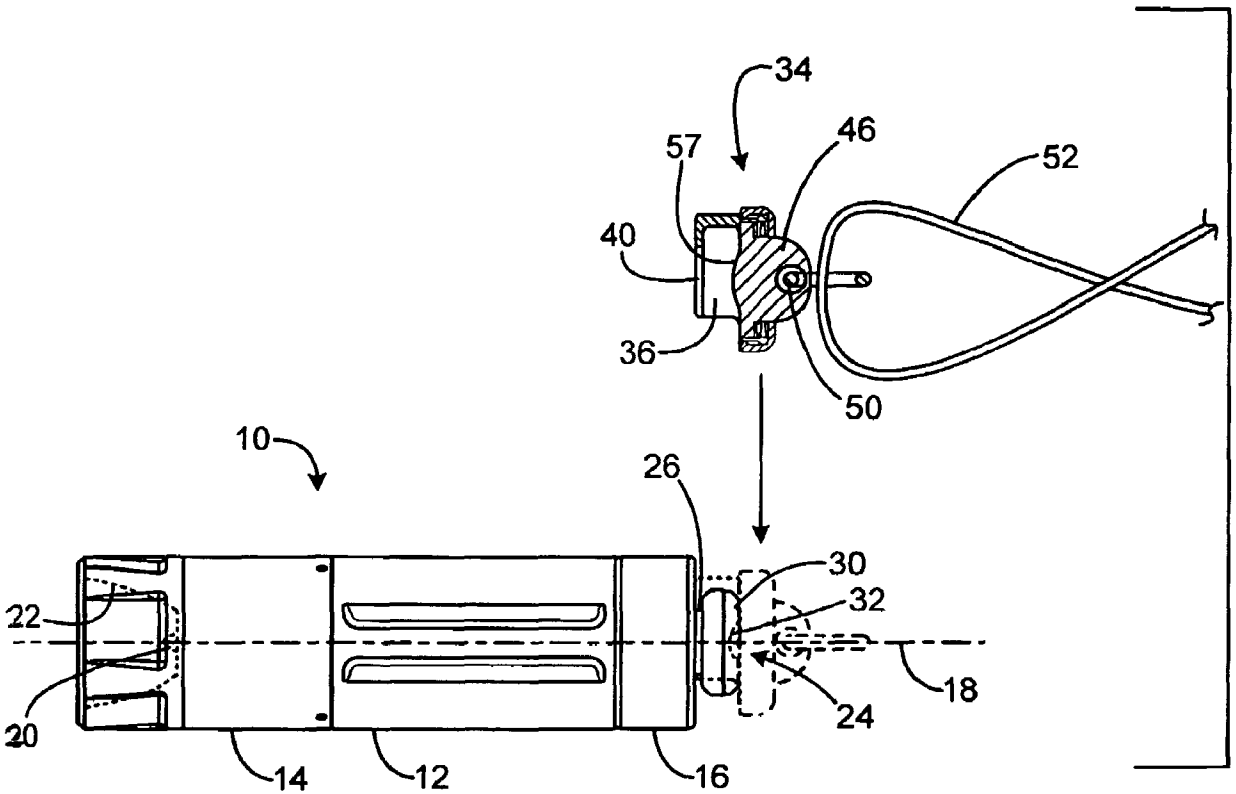
FIG. 1*a* is a side view of a flashlight according to a preferred embodiment of the invention.

FIG. 1*a* shows a flashlight 10 according to a preferred embodiment of the invention. The flashlight includes a major housing portion 12 having a rotatable head 14 connected at a forward end, and a rear tailcap 16 connected at a rear end. The major portions of the housing are cylindrical, and define axis 18. The head 14 includes an LED lamp 20 and reflector 22 that project a beam in the forward direction when the light is operated.

The tailcap includes a mechanism for removably attaching the flashlight to a support facility such as a lanyard, a bracket, or other fixed or support element. In the illustrated embodiment, the tailcap has a rearward protruding element or button 24 having a short cylindrical shank 26 and an enlarged round head 30. A recess or dimple 32 is defined in the rear face of the head 30. The element 24 may be described as a nailhead. The tailcap is internally threaded so that it may be removably secured to the body 12. This allows replacement with alternative tailcaps such as discussed below.

A removable lanyard element 34 operates to quickly attach and detach from the button 24 by sliding laterally off the button in a direction perpendicular to the axis of the flashlight. The lanyard element is designed to be secure against substantial axial force. As shown in FIGS. 1*a* and 1*b*, the lanyard element defines a lateral pocket 36 that receives the button when the element is installed. The pocket is formed by a foreward U-shaped portion 40 that defines a central aperture 42, which is sized to receive the shank 26.

The lanyard element has a body 44 having a rear extension 46 that defines an aperture 50 receiving a lanyard cord 52. The lanyard element includes a spring (not shown) within the body that biases a rigid plate 54 in the forward direction. The plate 54 has a central protruding bump 57 that mates with the button's recess 32 when the lanyard element is installed. This prevents the lanyard element from being removed by limited force due to inadvertent contact, and provides a positive tactile indication when the lanyard element is installed.

The tailcap, button, and installed lanyard element all extend from the rear end of the flashlight, and are all contained within an envelope defined by the exterior of the generally cylindrical body of the housing 12. Nothing in the detachment elements extends to a greater radius than the body of the flashlight. This provides an advantage over a removable mount that protrudes from a lateral side of the flashlight, because it provides a cleaner profile that is more readily and comfortably gripped, and more compactly stowed.

Figure 2:
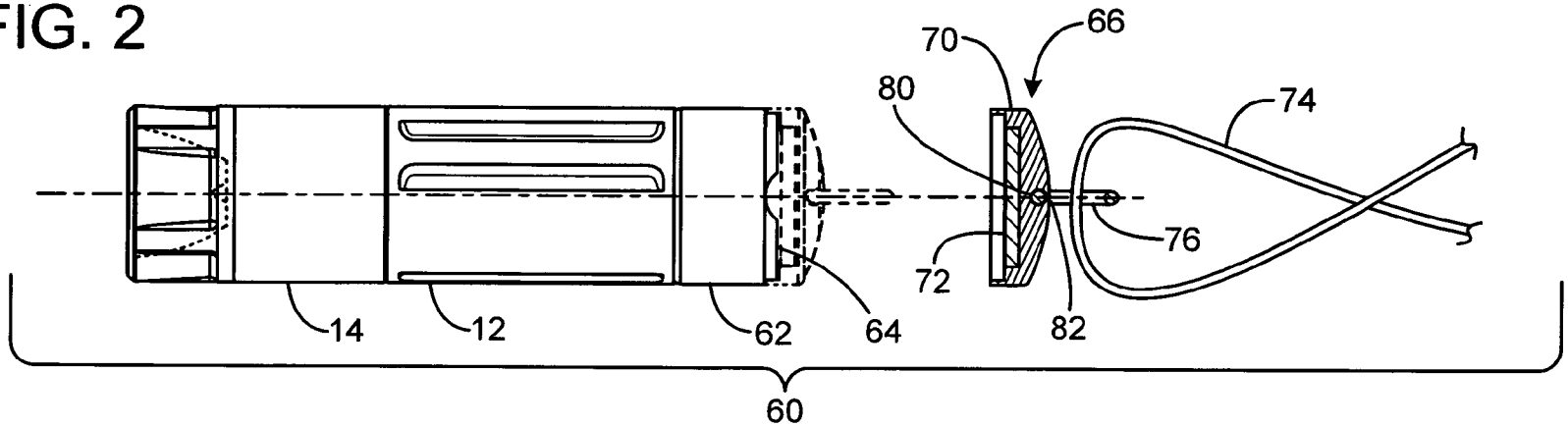
FIG. 2 is a side view of a flashlight according to an alternative embodiment of the invention.

An alternative flashlight 60 is shown in figure 2, and has an alternative tailcap 62. The tailcap 62 includes a flat rear end face 64 formed of a ferromagnetic material. A removable end cap 66 is in the form of a lid having a rim 70, and a magnet 72 positioned to contact the end face 64. A lanyard 74 is connected by way of a jump ring 76 to an aperture 80 formed in a tang 82 that extends in a rearward direction. In the preferred embodiment, the magnet provides a force to resist removal. The rear end portion of the tailcap tat terminates in face 64 has a slightly reduced diameter with respect to the overall diameter of the tailcap and the rest of the housing. This allows the end portion to be received within the rim 70, so that the end cap 66 cannot be removed by lateral sliding. The outside diameter of the end cap 66 is the same as the outside diameter of the rest of the tailcap and housing for a flush appearance.

Figure 3:
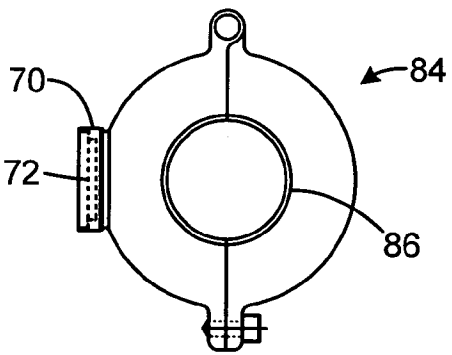
FIG. 3 is a sectional view of a flashlight mounting element according to an alternative embodiment of the invention.

FIG. 3 shows a bracket 84 to which the flashlight of FIG. 2 may be attached, in the same manner as to the end cap 66. The bracket 84 includes the same magnet 72 and rim 70. The illustrated bracket is shown with a clamping mechanism for securing to a tubular member 86 such as a bicycle handlebar. This allows the flashlight to be mounted for hands-free use, such as a bicycle headlight, and detachable for handheld use, or to prevent theft.

Figure 4:
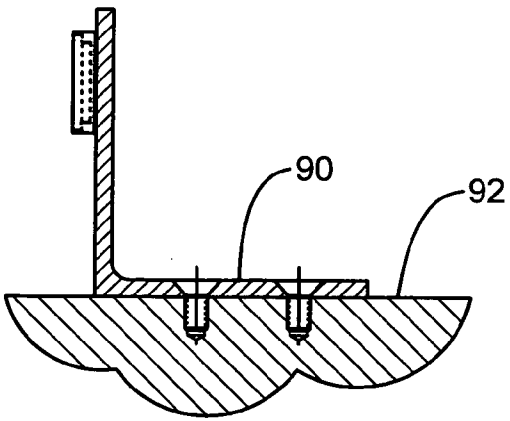
FIG. 4 is a sectional view of a flashlight mounting element according to an alternative embodiment of the invention.

FIG. 4 shows an alternative bracket 90 having the same magnet and rim configuration as above, but with an L-shaped bracket suitable for mounting on a flat fixed surface 92 such as a wall or bulkhead. This configuration may be useful when a flashlight needs to be stored in a convenient location for quick access. This may be useful for power outages, emergency or fire access, or for vehicle mounts.

FIG. 5 shows a firearm such as a semiautomatic pistol 94 having a frame rail 96 to which a bracket 100 is mounted. In the illustrated embodiment, the bracket includes a receptacle 102 having the same configuration as the element 34 shown in FIG. 1*b*. This allows a flashlight 10 to be removably connected to the pistol in order to illuminate a target area. In alternative embodiments, the magnetic tailcap connector may be employed instead. The ability to move a flashlight from one mounting location to another can be advantageous. For instance, a police officer may have a flashlight mounted to a tailcap connector on his belt, along with a conventionally holstered pistol. If the need arises to investigate a threat in a dark area, the pistol may be unholstered, and the flashlight transferred to the pistol mount. This avoids the need for a special holster to accommodate a flashlight, and avoids the inconvenience and weight of having a pistol-mounted flashlight for all circumstances where it might otherwise not be needed.

FIG. 6 is an end view of a bracket 104 mounted on a standard picatinny rail 106 such as found on the frame 110 of many types of military firearms. Connected to the bracket 104 is a receptacle 112 configured to receive the flashlight 10 shown in FIG. 1*a*. As above, the receptacle may be substituted with a magnetic type connector as in FIG. 2.

Figure 7:
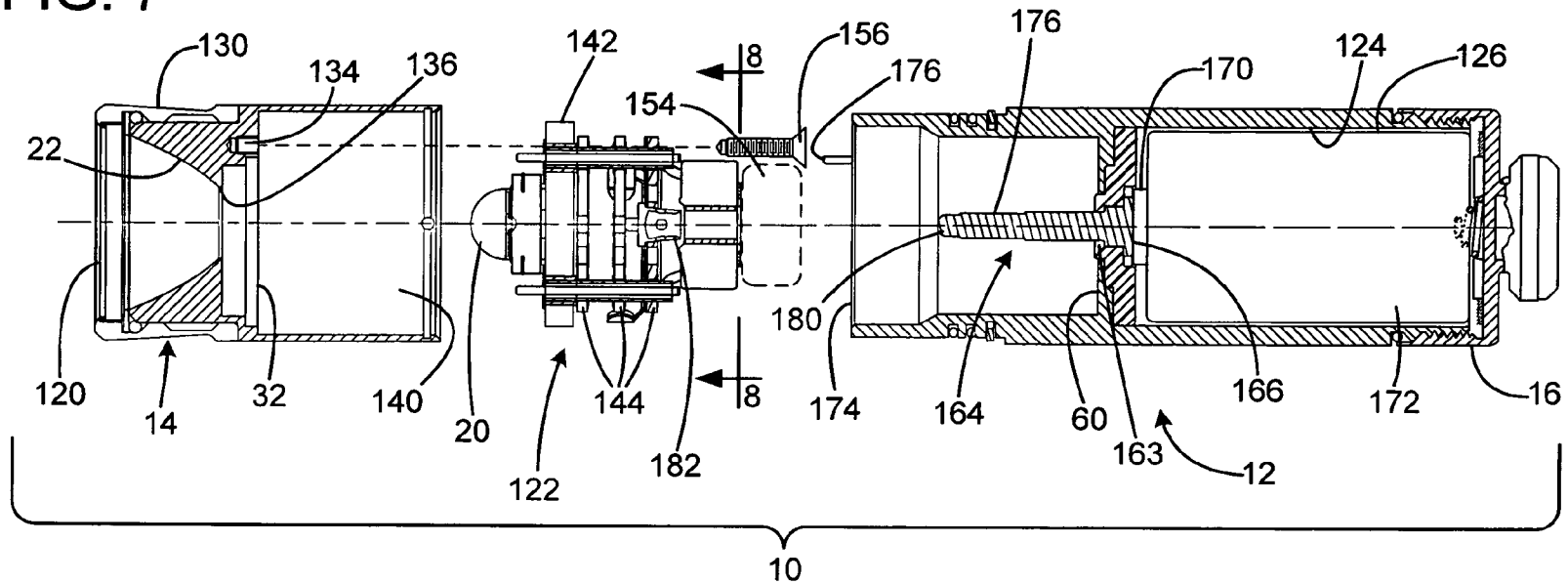
FIG. 7 is an exploded view of a flashlight according to a preferred embodiment of the invention.
Figure 8:
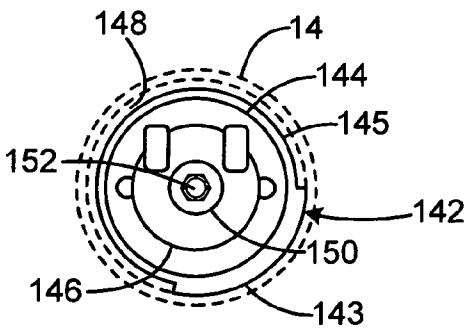
FIG. 8 is an axial view taken along line 8-8 of FIG. 7.

FIG. 7 shdws the flashlight 10 separated into several major subassemblies. A head 14 includes the reflector 22 and a lens 120. The lamp 20 is mounted to an electronic subassembly 122 having several circuit boards and electronic elements. The main housing 12 has the tailcap 16 connected at its rear end to define a chamber 124 that contains a battery 126.

The head includes a cylindrical outer housing 130 that closely receives the reflector and lens. The reflector has a rear face 32 that defines a threaded bore 134 offset from a central aperture 136. The housing 130 extends to the rear of the surface 132 to define a cylindrical chamber 140.

The electronic subassembly 122 is formed of a stack of essentially circular elements to form a cylindrical body. The elements are electronically and mechanically interconnected with each other to provide a controllable dimmable elimination function. The lamp 20 is mounted centrally on a circular heatsink panel 142 that has an essentially circular perimeter. Approximately one third of the perimeter 143 of the heatsink panel has a radius to match the interior of the chamber 140 of the head 14, for a close fit, and the remaining two thirds of the perimeter 145 is slightly smaller, to provide an arcuate gap 148 between the heatsink and the housing 130.

A stack of spaced-apart printed circuit boards 144 are connected to the heatsink, and each supports a number of electronic components. One of the boards includes radially-extending contacts (not shown) that provide a grounding contact to the interior of the housing 130. Connected to the rearmost board is a potentiometer 146. The potentiometer is controlled by a central rotor 150 defining an aperture 152. The aperture is in the form of a hexagonal cross-section, so that a hexagonal key inserted in the aperture may be turned to adjust the resistance presented by the potentiometer to the circuitry. A toroidal coil 154 is electrically connected to the circuitry, and defines a central aperture axially aligned with the aperture 152.

The electronic subassembly 122 is mechanically secured to the head assembly. The front face of the heatsink panel 142 is positioned against the rear face 132 of the reflector, and a threaded fastener 156 passes through a clearance hole in the heatsink, and is secured to the threaded bore 134.

The main housing 12 is essentially a cylindrical tube, with a barrier wall 60 at an intermediate location, and perpendicular to the tube axis. The barrier wall defines a central aperture that tightly receives an insulating sleeve 163 that retains a conductive metal key 164. The key has the shape of a nail, with a head 166, and an extending shank 176. The shank has a hexagonal cross-section sized and shaped to mate with the aperture 152 of the potentiometer. The key is installed so that the head 166 is positioned against the rear face of the wall 60, providing an electrical contact for the cathode 170 of the battery 172. In the preferred embodiment, the key is formed of brass. The key is mechanically secured to the housing 12 so that it is rotationally fixed with respect to the housing.

The flashlight is assembled by inserting the key through the aperture of the coil 154, into the hexagonal aperture 152 of the potentiometer 146, so that the free end 180 of the key makes continuous electrical contact with a pad 182 on a circuit board 144. The key thus serves as a power conduit to the electronic subassembly, while the metal housing 12 provides a ground connection. To make this electrically effective, the key is electrically isolated from the housing barrier wall 60 to which it is secured. cross-section sized and shaped to mate with the hexagonal aperture 152 of the potentiometer. The key is installed so that the head 166 is positioned against the rear face of the wall 160, providing an electrical contact for the cathode 170 of the battery 172. In the preferred embodiment, the key is formed of brass. The key is mechanically secured to the housing 12 so that it is rotationally fixed with respect to the housing.

The flashlight is assembled by inserting the key through the aperture of the coil 154, into the hexagonal aperture 152 of the potentiometer 146, so that the free end 180 of the key makes continuous electrical contact with a pad 182 on a circuit board 144. The key thus serves as a power conduit to the electronic subassembly, while the metal housing 12 provides a ground connection. To make this electrically effective, the key is electrically isolated from the housing barrier wall 160 to which it is secured.

A forward rim edge 174 of the housing 12 includes a protruding tab 176. When the housing is assembled, the tab rides in the arcuate slot formed by the perimeter of the heatsink 142. Because the slot is limited to only two thirds of the perimeter of the heatsink, this provides a rotation range of two thirds of one complete rotation of the head, with a stop at each end. In the preferred embodiment, the light is an off condition when at one limit of rotation, and a maximum brightness condition at the other limit of rotation, with a range of intermediate dim levels in between, ramping up from a low illumination level adjacent to the off position, and increasing proportionately until the maximum position is reached.

In alternative embodiments, a switching and dimming control based on rotational head position may be provided by means other than the potentiometer. Alternative control means may include Hall effect switches based on position, wiping contacts with an arcuate resistor or resistor network, and a series of incremental switch contacts providing different dim levels.

The lamp 20 is preferably a light-emitting diode (LED), and may be a single lamp that operates efficiently over a wide range of input power to produce a wide range of possible light outputs. In alternative embodiments, there may be multiple light sources, either interconnected to provide a single, switchable (and dimmable) array, with all sources operating in the same manner. In other alternatives, there may be separate lamps or independently controllable lamp elements, so that color hue changes may be obtained by operating different color components in different combinations, or so that dimming control may be obtained by illuminating a different number of the components. The lamp may be an alternative light source, such as a tungsten halogen lamp or any other light source, although LED lamps are believed best suited to presently provide efficiency over a wide range of powers and brightness.

This disclosure is made in terms of preferred and alternative embodiments, and is not intended to be so limited. For instance, either the spring-biased detachable mounting or the magnetic mounting may be interchanged for any application. The mounting may be located at other positions on the flashlight.

The invention claimed is:

1. A flashlight comprising:

a lamp having a plurality of operating states including an off state and a plurality of different brightness level output states;

a housing;

a head rotatably attached to the housing;

a potentiometer having a body mechanically connected to the head and a rotatable control element mechanically connected to the housing, wherein the rotatable control element includes a central aperture, and wherein the housing includes a key element mechanically engaging the control element at the aperture; and the lamp operating state being based on the rotational position of the head with respect to the housing.

2. The flashlight of claim 1, wherein the housing and the head are cylindrical elements having a common diameter.

3. The flashlight of claim 1, wherein the head includes the lamp.

4. The flashlight of claim 1, including circuitry operably connected to the lamp.

5. The flashlight of claim 4, wherein the circuitry includes a circuit element having a rotatable control input, such that the electrical state of the circuit element changes based on the position of the control input.

6. The flashlight of claim 5, wherein the control input is entirely contained within the housing.

7. The flashlight of claim 5, wherein the control input is rotatable about an axis coincident with a major axis defined by the housing.

8. The flashlight of claim 5, wherein the control input is connected to the housing.

9. The flashlight of claim 1, wherein the head has a limited range of rotational motion between a first limit and a second limit with respect to the housing.

10. The flashlight of claim 9, wherein the first limit corresponds to an off condition, the second limit corresponds to a maximum brightness condition, and wherein intermediate positions between the first and second limit correspond to intermediate dim levels.

11. A flashlight comprising:

a lamp having a plurality of operating states including an off state and a plurality of different brightness level output states;

an elongated housing having opposed forward and rear ends;

a head rotatably attached to the forward end of the housing;

a potentiometer having a body mechanically connected to the head and a rotatable control element mechanically connected to the housing, wherein the rotatable control element includes a central aperture, and wherein the housing includes a key element mechanically engaging the control element at the aperture; and the lamp operating state being based on the rotational position of the head with respect to the housing.

12. A method of operating a flashlight having a lamp having a plurality of operating states including an off state and a plurality of different brightness level output states, a housing, a head rotatably attached to the housing, a potentiometer having a body mechanically connected to the head and a rotatable control element mechanically connected to the housing, wherein the rotatable control element includes a central aperture, and wherein the housing includes a key element mechanically engaging the control element at the aperture, the lamp operating state being based on the rotational position of the head with respect to the housing, the head being rotatable with respect to the housing through a range of positions from a first limit to a second limit, the method comprising the steps:

when positioning the head at the first limit, maintaining the lamp in an off-condition;

when positioning the head at the second limit, illuminating the lamp to a maximum brightness level;

when positioning the head at an intermediate position between the first limit and the second limit, illuminating the lamp at a dim brightness level; and the dim brightness level being proportional to the rotational position.

13. The method of claim 12, including the step of changing the brightness level by rotating the head.

14. The method of claim 13, wherein the step of rotating includes engaging a rotatable portion of an adjustable electrical component on the head with an element on the housing, and rotating the rotatable element by rotating the head with respect to the housing.

15. A flashlight comprising:

a lamp having a plurality of operating states including an off state and a plurality of different brightness level output states;

a housing;

a head rotatably attached to the housing;

a potentiometer having a body mechanically connected to the head and a rotatable control element mechanically connected to the housing, wherein the rotatable control element includes a central aperture, and wherein the housing includes a key element mechanically engaging the control element at the aperture;

the lamp operating state being based on the rotational position of the head with respect to the housing;

the head being rotatable with respect to the housing through a range of positions from a first limit to a second limit; and circuitry connected to the lamp to operate the lamp at an operating state based on the rotational position of the head with respect to the housing.

16. The flashlight of claim 15, wherein the housing and the head are cylindrical elements having a common diameter.

17. The flashlight of claim 15, wherein the circuitry includes a circuit element having a rotatable control input, such that the electrical state of the circuit element changes based on the position of the control input.

18. The flashlight of claim 17, wherein the control input is rotatable about an axis coincident with a major axis defined by the housing.

19. The flashlight of claim 15, including a removable end portion opposite the head, the end portion having a support facility operable to support the housing, such that a user does not need to contact the housing.

20. A flashlight comprising:

a lamp having a plurality of operating states including an off state and a plurality of different brightness level output states;

a housing;

a head rotatably attached to the housing;

a potentiometer having a body mechanically connected to the head and a rotatable control element mechanically connected to the housing, wherein the rotatable control element includes a central aperture, and wherein the housing includes a key element mechanically engaging the control element at the aperture;

the lamp operating state being based on the rotational position of the head with respect to the housing;

the housing having a removable portion; and the removable portion including a support facility operable to support the housing, such that a user does not need to contact the housing.

21. The flashlight of claim 20, wherein the housing is an elongated housing having opposed first and second ends, wherein the first end includes the lamp, and wherein the removable portion is connected to the second end.

22. The flashlight of claim 21, wherein the housing has a cylindrical profile defining an axis, and wherein the removable portion has a limited size that does not extend radially from the axis beyond the cylindrical profile.

23. The flashlight of claim 21, wherein the housing defines an axis, and wherein the removable portion is secured against removal by axial forces, and is removable by a force lateral to the axis.

24. The flashlight of claim 20, wherein the removable portion is magnetically attached to the housing.

25. The flashlight of claim 20, wherein the support facility is a lanyard.

26. The flashlight of claim 20, wherein the support facility is a mounting bracket.

27. The flashlight of claim 20, wherein the removable portion is a tail cap.

28. The flashlight of claim 20, wherein the removable portion is removable in response to application of linear force.

29. The flashlight of claim 20, wherein the housing has a detachable portion that removable portion of the housing remains normally attached to the flashlight for normal operation.

30. The flashlight of claim 20, wherein the removable portion is threadably connected to the flashlight housing.

31. The flashlight of claim 20, wherein the removable portion is adapted to be interchanged with a different removable portion of the housing including a different support facility, such that a user may select which type of support facility is employed.

* * * * *

UNITED STATES PATENT AND TRADEMARK OFFICE

CERTIFICATE OF CORRECTION

PATENT NO. : 7,517,109 B2
APPLICATION NO. : 11/700755
DATED : April 14, 2009
INVENTOR(S) : Paul Y. Kim, John W. Matthews and Robert L. Kolb It is certified that error appears in the above-identified patent and that said Letters Patent is hereby corrected as shown below:

On the title page, in the drawing, change “32” to --132-- and change “60” to --160--.

In the drawings, sheet 4, FIG. 7, change “32” to --132-- and change “60” to --160--.

In column 3, line 61, change “tat” to --that--.

In column 4, line 40, change “shdws” to --shows--.

In column 4, line 48, change “32” to --132--.

In column 5, line 14, change “60” to --160--.

In column 5, line 21, change “60” to --160--.

In column 5, delete the text in lines 26 to 41 beginning with “The flashlight” in line 26 and ending with “housing.” in line 41.

Signed and Sealed this

Fourteenth Day of July, 2009

John Doll

JOHN DOLL
*Acting Director of the United States Patent and Trademark Office*